US010274162B2

(12) United States Patent
Peck et al.

(10) Patent No.: US 10,274,162 B2
(45) Date of Patent: Apr. 30, 2019

(54) OMNIDIRECTIONAL LED AND REFLECTOR WITH SHARP HORIZONTAL CUTOFF

(71) Applicant: DIALIGHT CORPORATION, Farmingdale, NJ (US)

(72) Inventors: John Patrick Peck, Brielle, NJ (US); Cecil D. Thomas, Matawan, NJ (US)

(73) Assignee: DIALIGHT CORPORATION, Farmingdale, NJ (US)

( * ) Notice: Subject to any disclaimer, the term of this patent is extended or adjusted under 35 U.S.C. 154(b) by 0 days.

(21) Appl. No.: 15/888,578

(22) Filed: Feb. 5, 2018

(65) Prior Publication Data

US 2018/0156419 A1 Jun. 7, 2018

Related U.S. Application Data

(63) Continuation of application No. 14/584,697, filed on Dec. 29, 2014, now Pat. No. 9,903,560, which is a (Continued)

(51) Int. Cl.

| | |
|---|---|
| ***F21V 1/00*** | (2006.01) |
| ***F21V 11/00*** | (2015.01) |
| ***F21V 7/04*** | (2006.01) |
| ***F21V 13/04*** | (2006.01) |

(Continued)

(52) U.S. Cl.

CPC ..... *F21V 7/04* (2013.01); *F21V 7/06* (2013.01); *F21V 11/16* (2013.01); *F21V 13/04* (2013.01);

(Continued)

(58) Field of Classification Search

CPC . F21V 7/0008; F21V 7/04; F21V 7/06; F21V 11/16; F21V 13/04; F21V 13/10; F21W 2111/00; F21W 2111/06

(Continued)

(56) References Cited

U.S. PATENT DOCUMENTS

| | | | |
|---|---|---|---|
| 5,155,666 | A | 10/1992 | Radford et al. |
| 2005/0068777 | A1 | 3/2005 | Popovic |

(Continued)

FOREIGN PATENT DOCUMENTS

| | | | |
|---|---|---|---|
| EP | 2 320 131 | A1 | 5/2011 |
| FR | 2 866 693 | A1 | 8/2005 |

(Continued)

OTHER PUBLICATIONS

International Search Report and Written Opinion of PCT/US2013/058247, dated Dec. 2013, consists of 10 pages.

(Continued)

*Primary Examiner* — Jason M Han

(57) ABSTRACT

The present disclosure relates generally to an omnidirectional light optic. In one embodiment, the omnidirectional light includes a plurality of reflectors, wherein each one of the plurality of reflectors comprises at least two reflective sides, wherein each one of the at least two reflective sides has an associated optical axis, wherein each respective optical axis of the at least two reflective sides is located on a common horizontal plane and each one of the at least two reflective sides comprises a curved concave cross-section, a plurality of LEDs, wherein each one of the plurality of reflectors is associated with at least one of the plurality of LEDs and at least one blocking band member with at least one edge that blocks light emitted by the plurality of LEDs at common horizontal angles.

18 Claims, 19 Drawing Sheets

Related U.S. Application Data continuation of application No. 13/607,144, filed on Sep. 7, 2012, now Pat. No. 8,919,995.

(51) Int. Cl.

| | |
|---|---|
| ***F21V 7/06*** | (2006.01) |
| ***F21V 11/16*** | (2006.01) |
| ***F21V 13/10*** | (2006.01) |
| *F21V 7/00* | (2006.01) |
| *F21W 111/00* | (2006.01) |
| *F21W 111/04* | (2006.01) |
| *F21Y 103/10* | (2016.01) |
| *F21Y 115/10* | (2016.01) |

(52) U.S. Cl.
CPC ..... *F21V 13/10* (2013.01); *F21V 7/0008* (2013.01); *F21W 2111/00* (2013.01); *F21W 2111/04* (2013.01); *F21Y 2103/10* (2016.08); *F21Y 2115/10* (2016.08)

(58) Field of Classification Search
USPC ... 362/241, 247, 249.02, 540, 542, 543–545
See application file for complete search history.

(56) References Cited

U.S. PATENT DOCUMENTS

| | | | | |
|---|---|---|---|---|
| 2005/0146875 | A1 | 7/2005 | Klein | |
| 2009/0207605 | A1* | 8/2009 | Fields | F21V 7/00 362/231 |
| 2010/0220478 | A1 | 9/2010 | Fields | |
| 2011/0103057 | A1 | 5/2011 | Chen | |
| 2011/0235322 | A1 | 9/2011 | Fields et al. | |
| 2011/0305014 | A1 | 12/2011 | Peck | |

FOREIGN PATENT DOCUMENTS

| | | | |
|---|---|---|---|
| WO | WO 2006/070050 | A1 | 7/2006 |
| WO | WO 2009/059125 | A1 | 5/2009 |

OTHER PUBLICATIONS

Supplemental EP Search Report, dated Apr. 26, 2016, consists of 10 pages.

* cited by examiner

OMNIDIRECTIONAL LED AND REFLECTOR WITH SHARP HORIZONTAL CUTOFF

CROSS-REFERENCE TO RELATED APPLICATIONS

This application is a continuation of recently allowed U.S. patent application Ser. No. 14/584,697, filed on Dec. 29, 2014, which is a continuation of U.S. patent application Ser. No. 13/607,144, filed on Sep. 7, 2012, now U.S. Pat. No. 8,919,995, which are herein incorporated by reference in their entirety.

BACKGROUND

A beacon light can be used to mark an obstacle that may provide a hazard to vehicles, aircrafts and boats. Previous beacon lights generally exhibit relatively poor energy efficiency, which can prohibit the use of solar panels to power the beacon light. Previous beacon lights may also contribute to light pollution, i.e., direct light at angles undesirably above and below a specified plane.

Some beacons, such as those used for marine navigation, require that the light only be seen when viewed from a specific angle or angular range. The light must be blocked from other specific angles or angular range. This allows ships to navigate safely by allowing them to identify the beginning or end of a hazard. Blocking the light output from certain angles eliminates confusion when multiple lights are located in a common area. This also allows ships to navigate safely by allowing them to identify the beginning or end of a hazard.

Some beacons use multiple light sources arranged along a horizontal plane. However, blocking the light output when using multiple light sources arranged along a horizontal plane does not provide for a sharp cutoff of the light in the horizontal axis. This is because the shield gradually blocks the light from each light source as the ship passes. As a result, the light will appear to slowly fade out as a ship passes by the beacon light.

SUMMARY

The present disclosure relates generally to an omnidirectional light optic having a horizontal cutoff. In one embodiment, the omnidirectional light optic comprises a plurality of reflectors, wherein each one of the plurality of reflectors comprises at least two reflective sides, wherein each one of the at least two reflective sides has an associated optical axis, wherein each respective optical axis of the at least two reflective sides is located on a common horizontal plane and each one of the at least two reflective sides comprises a curved concave cross-section, a plurality of light emitting diodes (LEDs), wherein each one of the plurality of reflectors is associated with at least one of the plurality of LEDs, wherein each one of the plurality of LEDs and each one of the plurality of reflectors is vertically stacked with respect to one another and at least one blocking band member with at least one edge that blocks light emitted by the plurality of LEDs at common horizontal angles.

The present invention also provides a second embodiment of an omnidirectional light having a horizontal cutoff. In the second embodiment, the omnidirectional light comprises a plurality of light optics, wherein each one of the plurality of light optics is vertically stacked and at least one blocking band member with at least one edge that blocks light emitted by the at least one LED at common horizontal angles. Each one of the plurality of light optics comprises at least one reflector , wherein the at least one reflector comprises at least two reflective sides that converge at an apex, wherein each one of the at least two reflective sides has an associated optical axis, wherein each respective optical axis of the at least two reflective sides is located on a common horizontal plane, wherein each one of the at least two reflective sides comprises a curved concave cross-section and at least one light emitting diode (LED), wherein the at least one LED is positioned below the apex of the at least one reflector.

The present invention also provides a second embodiment for an omnidirectional light having a sharp horizontal cutoff. In one embodiment, the omnidirectional light comprises a first light optic, a second light optic, a third light optic and at least one blocking band member with at least one edge that blocks light emitted by the first LED, the second LED and the third LED at common horizontal angles. The first light optic comprises a bottom plate, a first top plate, a first reflector coupled to the first top plate, wherein the first reflector comprises at least two reflective sides that converge at an apex, wherein each one of the at least two reflective sides comprises a curved cross-section, a first light emitting diode (LED) coupled to the bottom plate, wherein a central light emitting axis of the first LED is positioned at the apex of the first reflector and one or more first standoffs coupled to the first top plate and the first bottom plate. The second reflector comprises a second top plate, a second reflector coupled to the second top plate, wherein the second reflector comprises at least two reflective sides that converge at an apex, wherein each one of the at least two reflective sides comprises a curved cross-section, a second LED coupled to the first top plate, wherein a central light emitting axis of the second LED is positioned at the apex of the second reflector and one or more second standoffs coupled to the first top plate and the second top plate. The third light optic comprises a third top plate, a third reflector coupled to the third top plate, wherein the third reflector comprises at least two reflective sides that converge at an apex, wherein each one of the at least two reflective sides comprises a curved cross-section, a third LED coupled to the second top plate, wherein a central light emitting axis of the third LED is positioned at the apex of the third reflector and one or more third standoffs coupled to the second top plate and the third top plate.

BRIEF DESCRIPTION OF THE DRAWINGS

So that the manner in which the above recited features of the present invention can be understood in detail, a more particular description of the invention may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures.

DETAILED DESCRIPTION

Embodiments of the present disclosure are directed towards an omnidirectional light having a sharp horizontal cutoff. The sharp cutoff is achieved using a blocking band member to block a set portion of light emitted by the omnidirectional light. As noted above, previous omnidirectional light sources use a horizontal arrangement of light sources along a plane. However, blocking the light output when using multiple light sources arranged along a horizontal plane does not provide for a sharp cutoff of the light in the horizontal axis. This is because the shield gradually blocks the light from each light source as the ship passes.

This can be seen in FIGS. 18A-18D. When the ship is at a starting position, all of the light emitted by the LEDs and reflected off of the reflector is visible and the intensity level seen by the observer would be at essentially 100% and illustrated by the right hand side of the graph in FIG. 19.

As the ship begins to pass the omnidirectional light, the light blocking band member creates an obstruction to the first LED and the light reflected by the reflector and, therefore, the light emitted by the first LED cannot be seen. The intensity level seen by the observer would be at about 67% and illustrated moving to the left of the graph and the first step down in FIG. 19.

As the ship pass further by the omnidirectional light then the light blocking band member creates an obstruction to the second LED and the light reflected by the reflector and, therefore, the light emitted by the second LED cannot be seen. The intensity level seen by the observer would be at about 33% and illustrated moving to the left of the graph and the second step down in FIG. 19.

As the ship pass even further by the omnidirectional light then the light blocking band member creates an obstruction to the third LED and the light reflected by the reflector and, therefore, the light emitted by the third LED cannot be seen. The intensity level seen by the observer would be at about 0% and illustrated moving to the left of the graph and the third step down in FIG. 19. As a result, the light will appear to slowly fade out as a ship passes by the beacon light.

Figure 19:
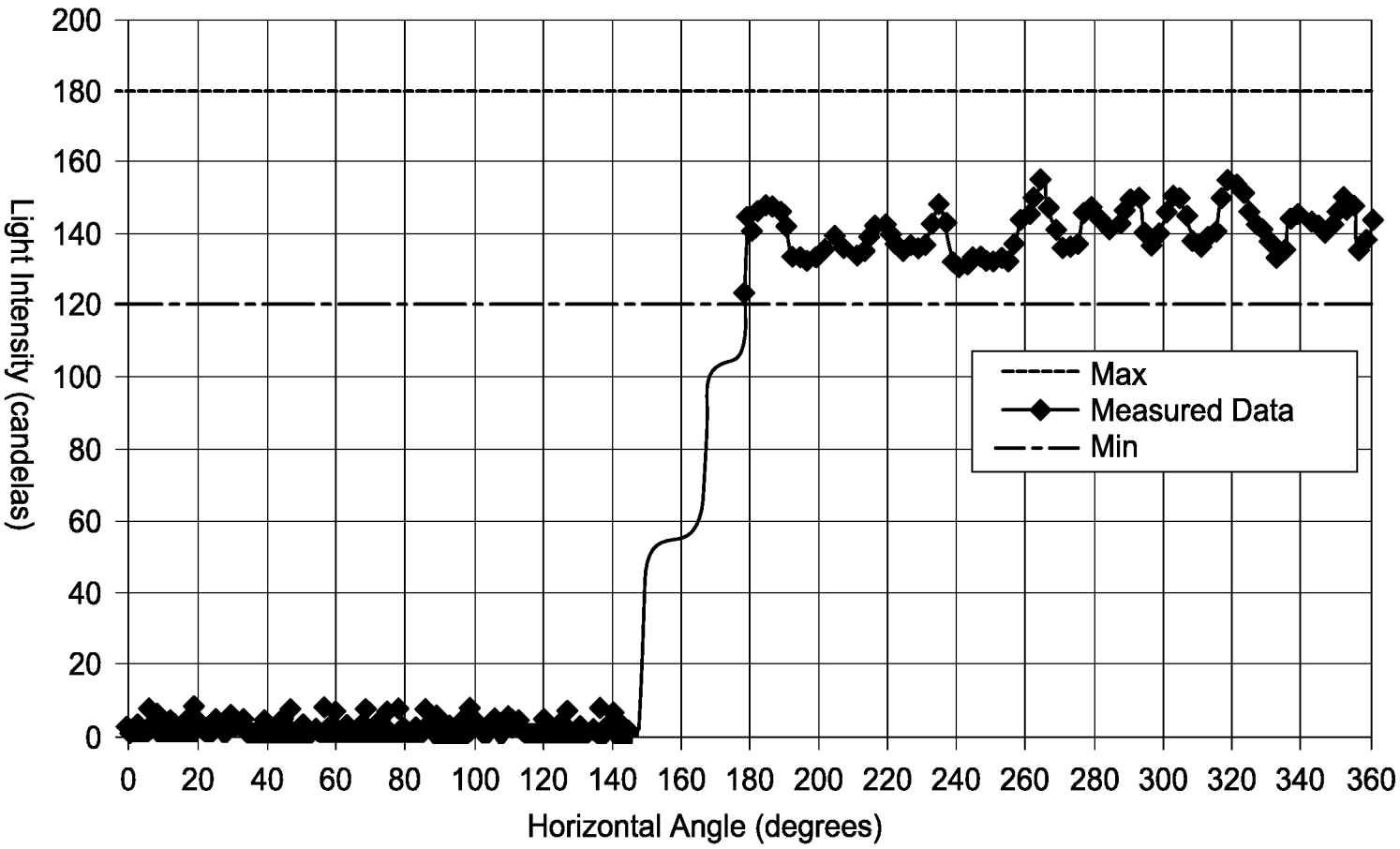
FIG. 19 depicts a graph of light intensity related to FIGS. 18A-18D.

The light cutoff for the horizontally aligned LED design shown in FIGS. 18A-18D would occur over a horizontal angle of greater than 15 degrees and may not be as conspicuous as would be desired. Note that the light emitted by each of the LEDs is redirected by the reflector in a narrow reflecting strip area 1802 of the reflector as shown by the bands illustrated in the reflector portions in FIG. 18A. Therefore, the light intensity will tend to step down each time an additional LED and narrow reflecting strip area 1802 is obstructed as shown in FIG. 19. This could also create confusion to the observer in the passing ship in that it may look like the light is unstable.

One embodiment of the present disclosure overcomes the deficiency of the horizontal arrangement of light sources by providing a vertically stacked arrangement of light sources. The vertically stacked arrangement provides an omnidirectional light source that has a sharp horizontal cutoff using a blocking band member.

Figure 1:
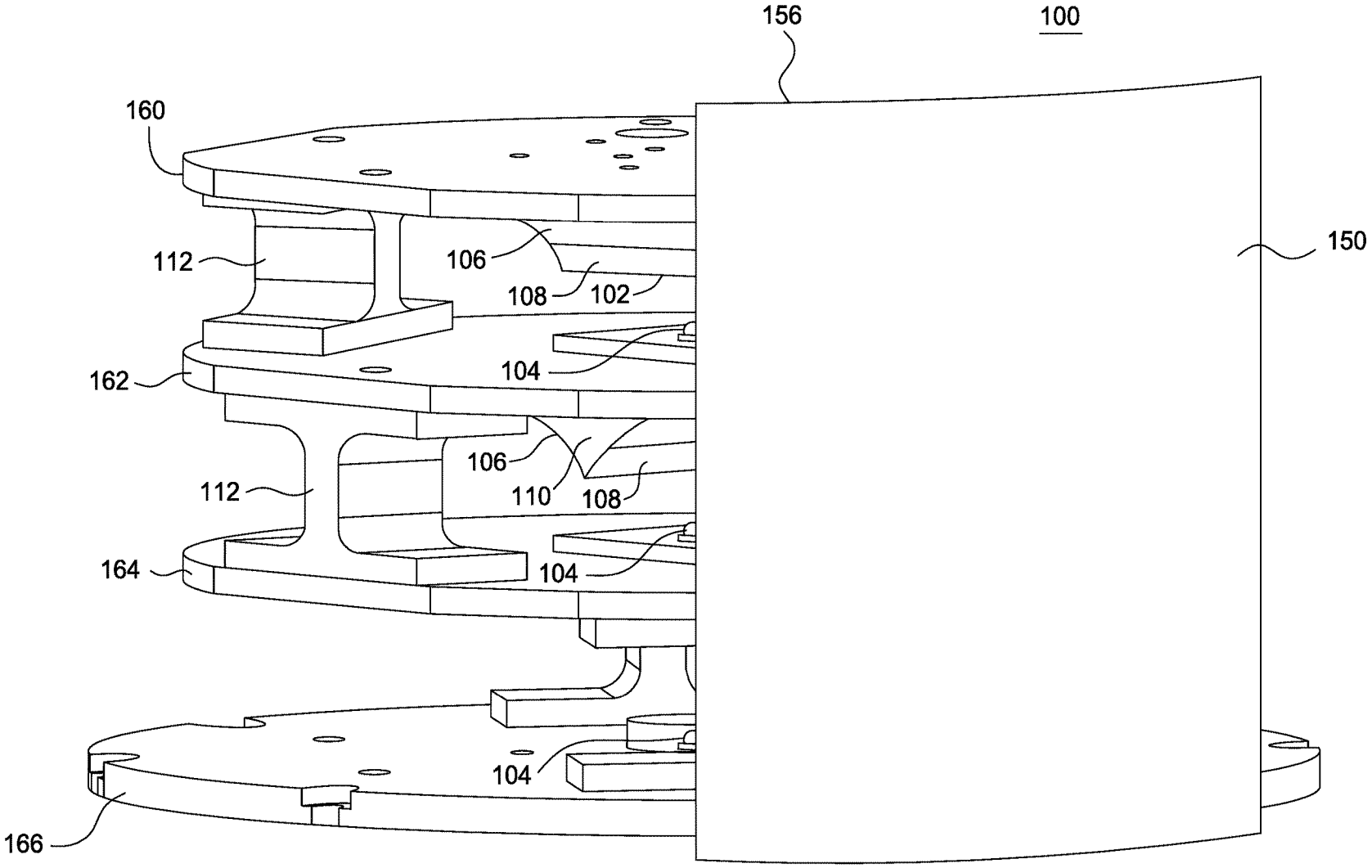
FIG. 1 depicts an isometric view of one embodiment of an omnidirectional light.

FIG. 1 illustrates one embodiment of the omnidirectional light source 100. In one embodiment, the omnidirectional light source 100 may include one or more light emitting diodes (LEDs) 104 and one or more reflectors 106. The LEDs 104 and the reflectors 106 may be mounted on some physical frame. In one embodiment, the physical frame includes one or more plates 160, 162, 164 and 166 supported and separated by one or more standoffs 112. In one embodiment, a blocking band member 150 may be used to block a portion of the light emitted by the LEDs 104 to achieve a sharp cutoff. In one embodiment, the horizontal cutoff may be approximately 3-10 degrees.

Figure 2:
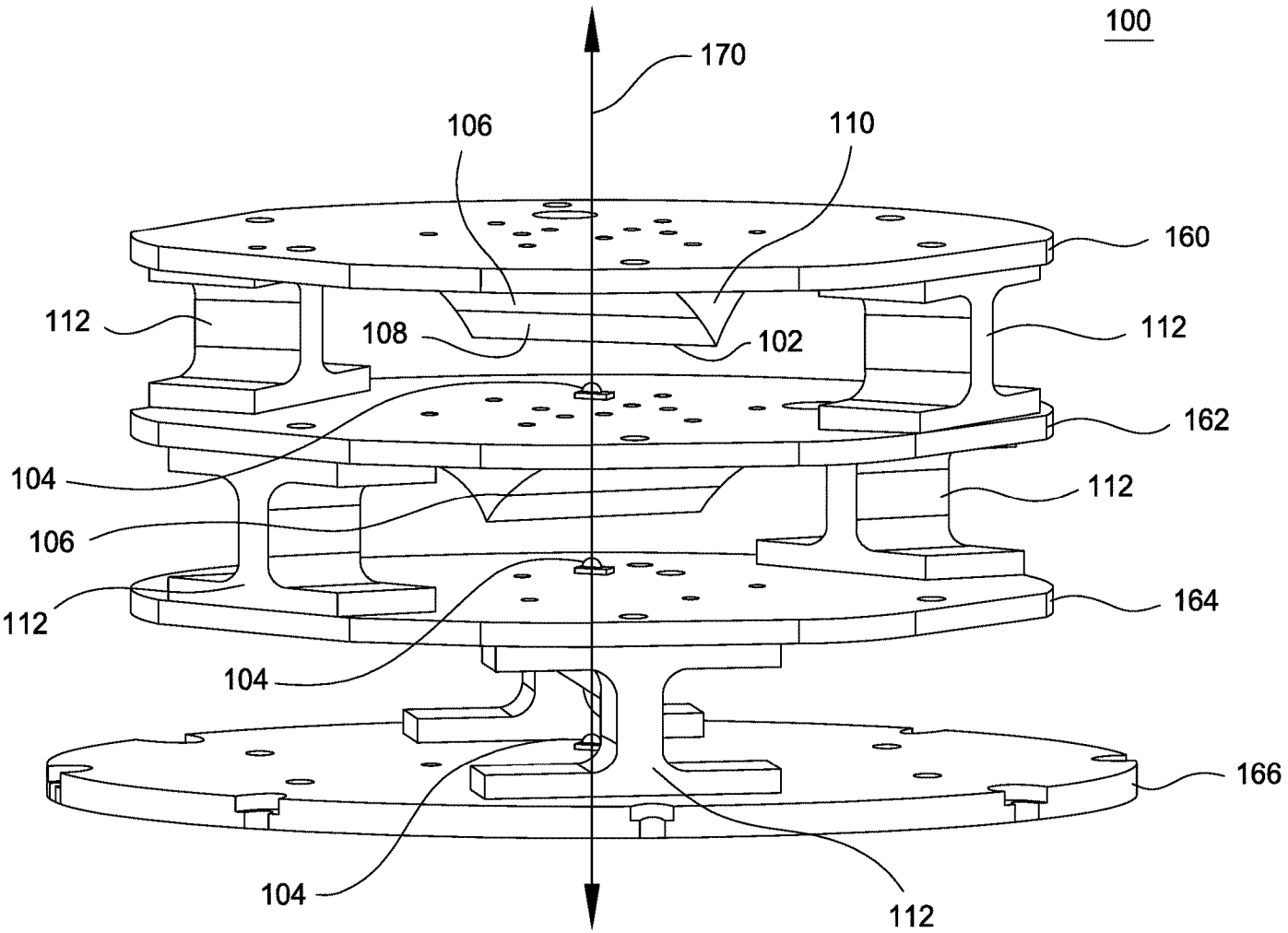
FIG. 2 depicts an isometric view of one embodiment of an omnidirectional light without a blocking band member.
Figure 15:
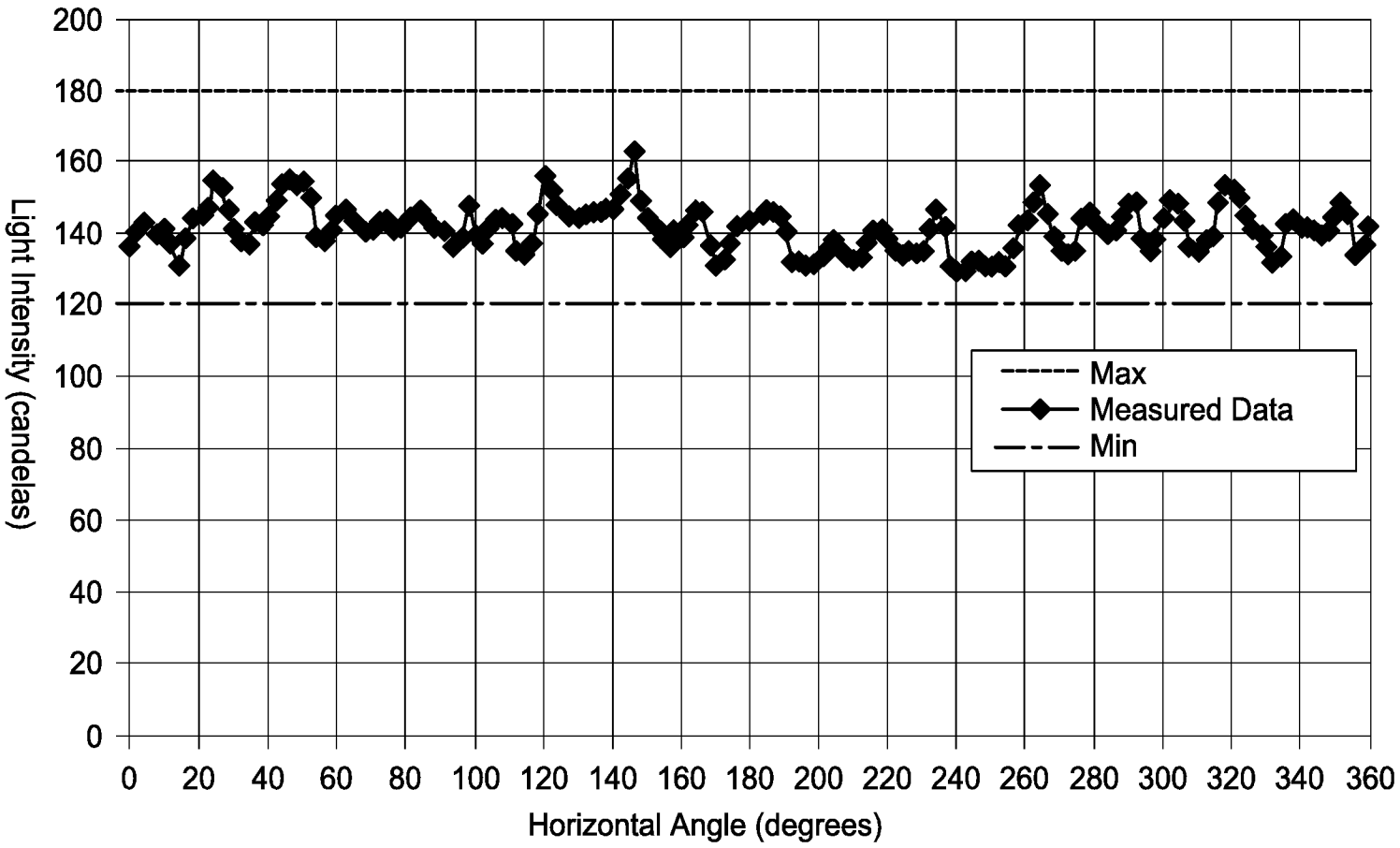
FIG. 15 depicts a graph of light intensity with no blocking.

FIG. 2 illustrates the omnidirectional light source 100, without the blocking band member 150. Without the blocking band member 150, the omnidirectional light source 100 provides light output 360 degrees around on a horizontal plane. FIG. 15 illustrates the light intensity of the omnidirectional light source 100 without the blocking band member 150. Notably, the light intensity remains relatively constant within an example minimum and maximum requirement for certain applications.

Figure 16:
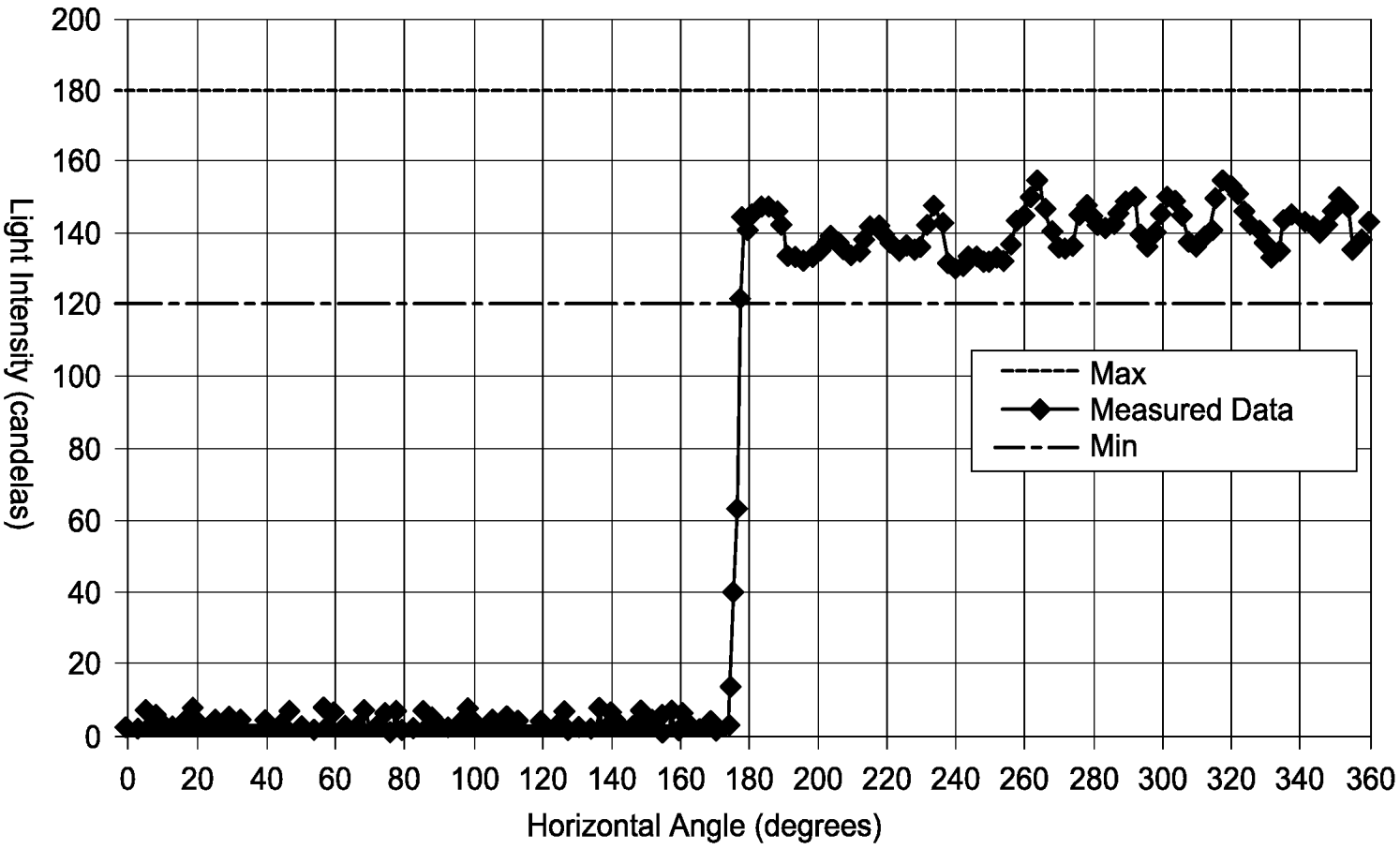
FIG. 16 depicts a graph of light intensity showing the sharp cutoff as the blocking band is moved in front of the LED.

Using the blocking band member 150 illustrated in FIG. 1, a sharp cutoff in the horizontal axis can be achieved. FIG. 16 illustrates how the light intensity is cut off between 174 to 181 degrees (i.e., within approximately 7 degrees) and drops from about 140 candelas to approximately zero candelas in the horizontal axis. In one embodiment, the horizontal cutoff for the designs of the present disclosure is less than 15 degrees.

In one embodiment, the blocking band member 150 may block light emitted from each one of the LEDs 104 at approximately the same horizontal angle. In one embodiment, the blocking band member 150 may block light emitted from each one of the LEDs 104 within +/−10 degrees of one another. For example, the blocking band member 150 may use a single continuous vertical edge 156 to block the light emitted from the each one of the LEDs 104. In one embodiment, the blocking band member 150 has at least one edge that blocks light emitted by the plurality of LEDs 104 at common horizontal angles. In one embodiment, the common horizontal angles may be within +/−10 degrees of each other.

In one embodiment, the blocking band member 150 may be made from a plastic or a metal. The blocking band member 150 may be fabricated as a single unitary piece or multiple pieces. In one embodiment, the blocking band member 150 may be coupled to the omnidirectional light source 100 directly on one of the plates (e.g., the plate 166), hung on a high hat coupled to the omnidirectional light source 100 or part of a different structure that is separate from the omnidirectional light source 100. In one embodiment, the blocking band member 150 may block approximately 180 degrees around (e.g., a semicircle shape) the omnidirectional light 100. In another embodiment, the blocking band member 150 may block approximately 90 degrees around the omnidirectional light 100. The blocking band member 150 may be positioned anywhere around the omnidirectional light source 100 depending on a desired light output direction of the omnidirectional light source 100 and where the light cutoff in the horizontal direction should occur.

Figure 5:
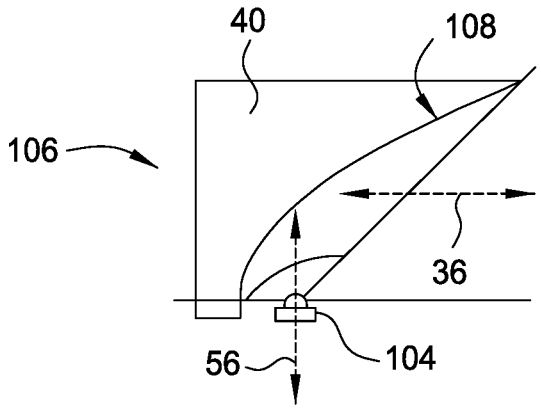
FIG. 5 depicts a cross sectional view of a reflective side of a reflector of the omnidirectional light.
Figure 7:
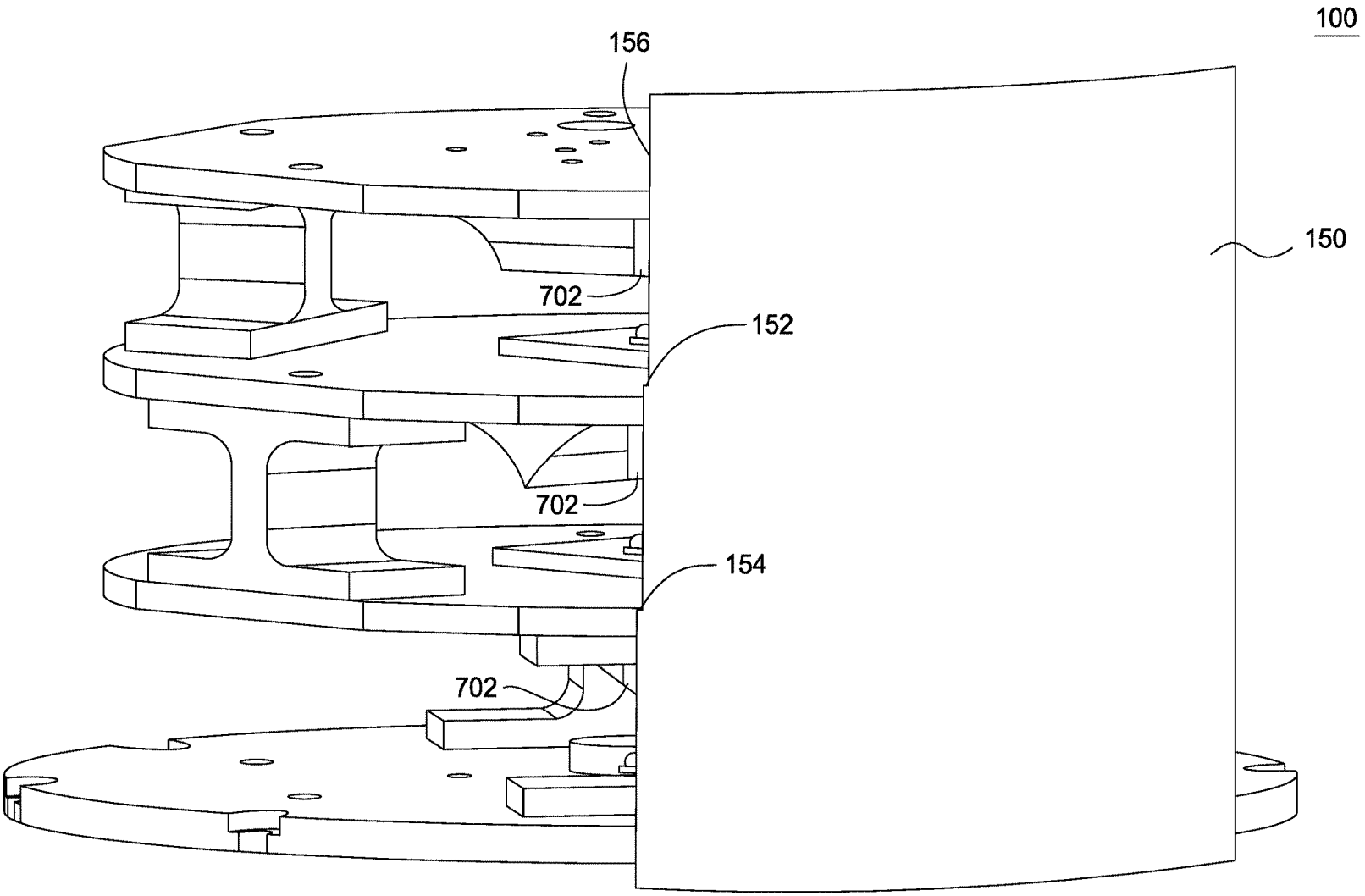
FIG. 7 depicts an isometric view of one embodiment of the omnidirectional light with an alternate embodiment of the blocking band member.

FIG. 7 illustrates an isometric view of one embodiment of the omnidirectional light 100 with an alternate embodiment of the blocking band member 150. The light blocking member 150 may have a stepped edge along the single continuous vertical edge 156 as shown in FIG. 7. FIG. 7 illustrates a step 152 and 154 for each level of the omnidirectional light 100. The stepped edges 152 and 154 may sharpen even further the horizontal cutoff since the narrow reflecting strip area 702 may be offset slightly between the one or more reflectors 106 of each level. The reflector strip area 702 is generally in line with the position of the LED 104 but may be slightly offset depending on the angle at which the omnidirectional light 100 is viewed. The location of the reflector strip area 702 may also be further offset depending on the shape of the curved cross section of the reflector 106. A parabolic or near-parabolic conic curved cross section minimizes the offset as shown in FIG. 5. Projecting the curved cross section along a linear extrusion axis, as shown in FIG. 2 for example, also minimizes the offset.

Referring back to FIG. 1, in one embodiment, the combination of the LED 104 and the reflector 106 may be referred to as a light optic. The omnidirectional light 100 may comprise a plurality of light optics stacked along a common vertical axis. Each one of the plurality of light optics may include a top plate 160 and a bottom plate 162. It should be noted that the bottom plate 162 of one of the plurality of light optics may serve as a top plate 162 of another one of the plurality of light optics. In other words, each one of the plurality of light optics may share at least one plate (e.g., plate 162 and 164). It should be noted that top and bottom are simply used as a reference and do not necessarily reference to gravity. That is to say the top and bottom plates could just as well be turned upside-down for example. In addition, as noted above, any physical frame to support the LED 104 and the reflector 106 may be used for example, a wire frame, bars, and the like. The plates 160, 162, 164 and 166 are illustrated as only one example of a physical frame that can be used.

Each one of the plurality of light optics may have at least one LED 104 coupled to the bottom plate 162. The number of LEDs 104 in each one of the plurality of light optics may depend on a particular application. For example, for a 5 nautical mile application, each one of the plurality of light optics may only require a single LED 104 and three vertical levels of light optics. For 10 nautical mile applications, each one of the plurality of light optics may require three or more LEDs 104 or a single LED 104 on six vertical levels of light optics, for example, and so forth. As noted, a single LED 104 would provide a sharper cutoff than multiple LEDs on a single level.

A reflector 106 may be coupled to the top plate 160. In addition, at least one standoff 112 may be coupled to the top plate 160 and the bottom plate 162.

A similar arrangement may be found for the light optic between the top plate 162 and the bottom plate 164 and for the light optic between the top plate 164 and the bottom plate 166. Although three light optics are illustrated by example in FIG. 1, it should be noted that any number (e.g., more or less) of light optics may be vertically stacked.

In one embodiment, the reflector 106 may include at least one reflective side 108. In the embodiment, illustrated in FIG. 1, the reflector 106 comprises two reflective sides 108 that are opposite one another. Said another way, the two reflective sides 108 may be located opposite each other and symmetric with respect to one another. Said another way, an optical axis 36 (illustrated for example in FIG. 5) of the first reflective side 108 may be angled at about 180 degrees with respect to the optical axis 36 of the second reflective side 108.

In one embodiment, each one of the at least one reflective sides 108 may have an associated optical axis 36. The optical axis 36 may be defined as an axis along which the main concentration of light is directed after reflecting off of the reflective side 108. The at least one reflective side 108 may be designed to collimate light along the optical axis 36 to about +/−10 degrees with respect to the optical axis 36.

In one embodiment, the at least one reflective side 108 may be designed to collimate light along the optical axis 36 non-symmetrically. For example, the at least one reflective side 108 may be designed to collimate light in the vertical direction but not significantly in the horizontal direction.

In one embodiment, an optical axis 36 of a first reflective side 108 may be located at about 180 degrees apart with respect to an optical axis 36 of a second reflective side 108. In one embodiment, an optical axis 36 of a first reflective side 108 may be located at about 180 degrees apart with respect to an optical axis 36 of a second reflective side 108 of a common reflector 106. The reflector 106 may also include at least one non-reflective side 110. In the embodiment, illustrated in FIG. 1, the reflector 106 may include two non-reflective sides 110 that are opposite one another. The term non-reflective may simply suggest that the side does not contribute significantly to the main light output. In one embodiment, the non-reflective side 110 provides less than 5% of the total light output of the omnidirectional light 100.

FIG. 5 illustrates a cross-sectional view of one embodiment of the at least one reflective side 108. FIG. 5 illustrates a cross-section 40 of the reflective side 108. In one embodiment, the cross-section 40 may be projected along a linear extrusion axis that is straight going into the page. In another embodiment, the cross-section 40 may be projected along a curve. For example, the curve may be convex, concave, or a combination of concave and convex.

The surface of the reflective side 108 may be curved. For example, the cross-section 40 may be curved in a conic or a substantially conic shape. In one embodiment, the conic shape may comprise at least one of: a hyperbola, a parabola, an ellipse, a circle, or a modified conic shape.

FIG. 5 illustrates an example of the optical axis 36 discussed above. In one embodiment, each one of the LEDs 104 may have a central light emitting axis 56. In one embodiment, the LED 104 may be positioned relative to the associated reflective side 108 such that the central light emitting axis 56 is of the LED 104 is angled at a predetermined angle relative to one or more optical axes 36. In one embodiment, the angle may be approximately 90 degrees with a tolerance of +/−30 degrees. In one embodiment, the LED 104 may be positioned relative to the associated reflective side 108 such that the central light emitting axis 56 is of the LED 104 is angled at a predetermined angle relative to two or more optical axes 36. In one embodiment, the angle may be approximately 90 degrees with a tolerance of +/−30 degrees.

The LED 104 may also be located below an apex 102 of the reflective sides 108. In one embodiment, the LED 104 may be located such that the central light emitting axis 56 is at a center point of an apex 102 of the reflective sides 108. For example, FIGS. 1 and 2 illustrate the reflector 106 having two reflective sides 108. The two reflective sides 108 converge on the apex 102 that is represented by a line where two edges of the reflective sides 108 meet. Thus, the LED 104 may be located such that the central light emitting axis 56 is at a midpoint of the apex 102. As a result the LED 104 may emit light that is reflected equally in two directions.

Figure 11:
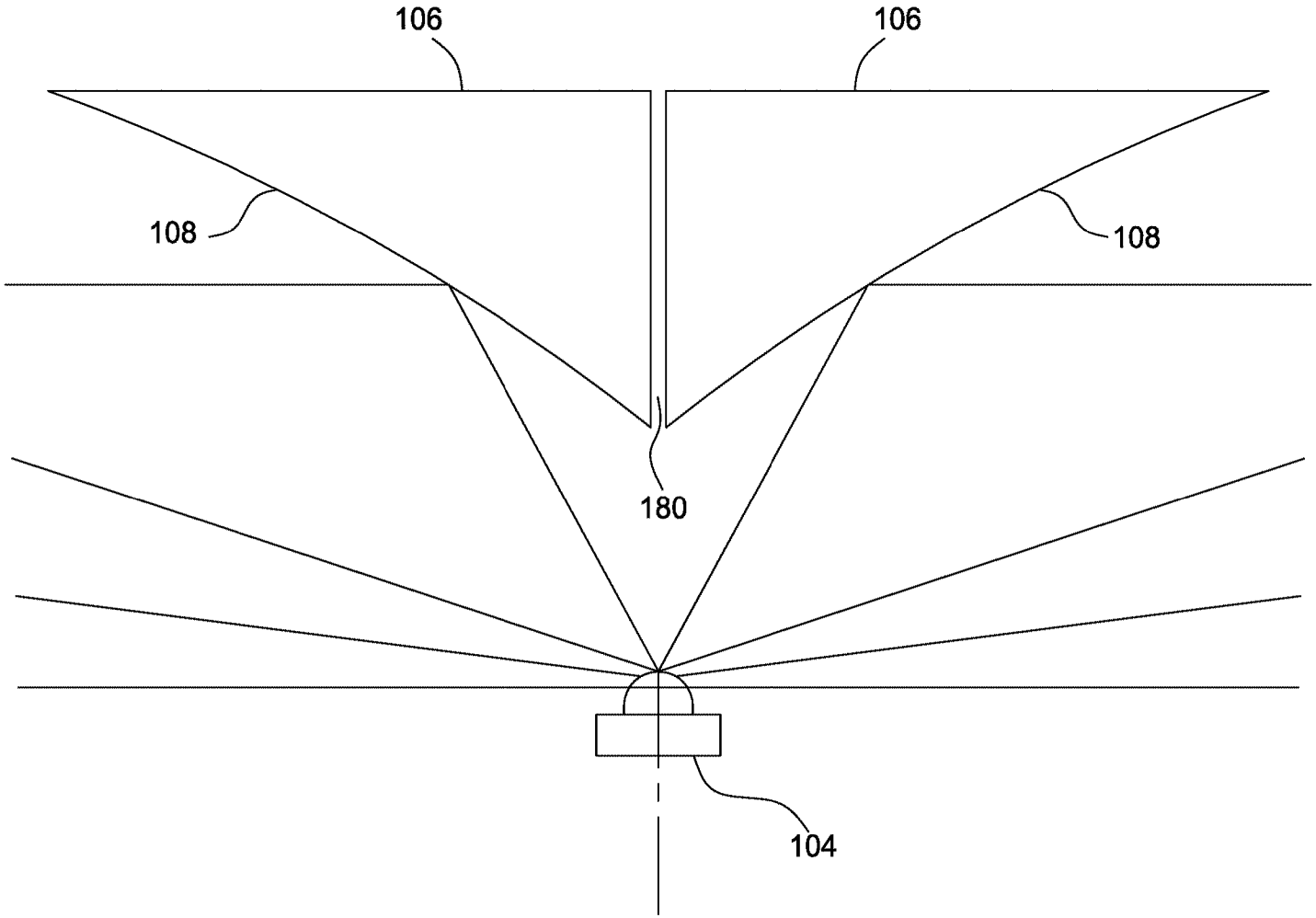
FIG. 11 depicts an embodiment of using two reflectors.

In one embodiment, the apex 102 of the reflector 106 may be formed by two separate reflectors 106, as illustrated in FIG. 11. For example, some embodiments may require that two physically separate reflectors 106 be used instead of a single reflector 106 having two or more reflective sides. This may be to provide a more accurate optical alignment with respect to the LED 104. For example, each physically separate reflector 106 may be adjusted independently with from one another. As a result, the apex 102 may be formed by two physically separate reflectors 106. In addition, a gap 180 may exist at the apex 102. Thus, the apex 102 may also be considered as an imaginary point where the two edges of the reflectors 106 would meet if the gap were absent.

Referring back to FIG. 1, the standoffs 112 may be positioned such that they are aligned with the non-reflective sides 110 of the reflector 106. For example, in the embodiment illustrated in FIG. 1, the standoffs 112 may be located at locations approximately 90 degrees along a horizontal plane with respect to the optical axis 36. As a result, the standoffs 112 will not interfere with the light output of the LEDs 104. In one embodiment, the standoffs 112 may be in a capitol "I" shape to reduce the surface area that could potentially interfere with the light output of the LEDs 104, but provide maximum support for the plates 160 and 162.

In an alternative embodiment, if the omnidirectional light 100 has a reflector 106 with more than two reflective sides 108, the standoffs 112 may be fabricated from a transparent material to minimize the amount of light that is blocked. In one embodiment, a cylinder that is transparent may be used to support the plates. In one embodiment a cylinder with cutouts may be used in the omnidirectional light 100. The cutouts may allow for higher light intensity, or adjustment of the light intensity, at specific angles. In one embodiment, a filter material may be used to reduce the light intensity at specific angles. The filter material may be positioned in the optical path between the LED 104 and reflector 106 or may be placed in the optical path after the reflector 106. The filter material may be a coating on the surface of the one or more of the reflective sides 108.

In one embodiment, each one of the plurality of light optics may be arranged vertically along a common vertical axis 170. Said another way, each LED 104 and an approximate center point of each one of the reflectors 106 all lay approximately along the vertical axis 170. In one embodiment, the center of each plate 160, 162, 164 and 166, the central light emitting axis 56 of each LED 104 and a center point of each one of the reflectors 106 all lay along the vertical axis 170.

Figure 6:
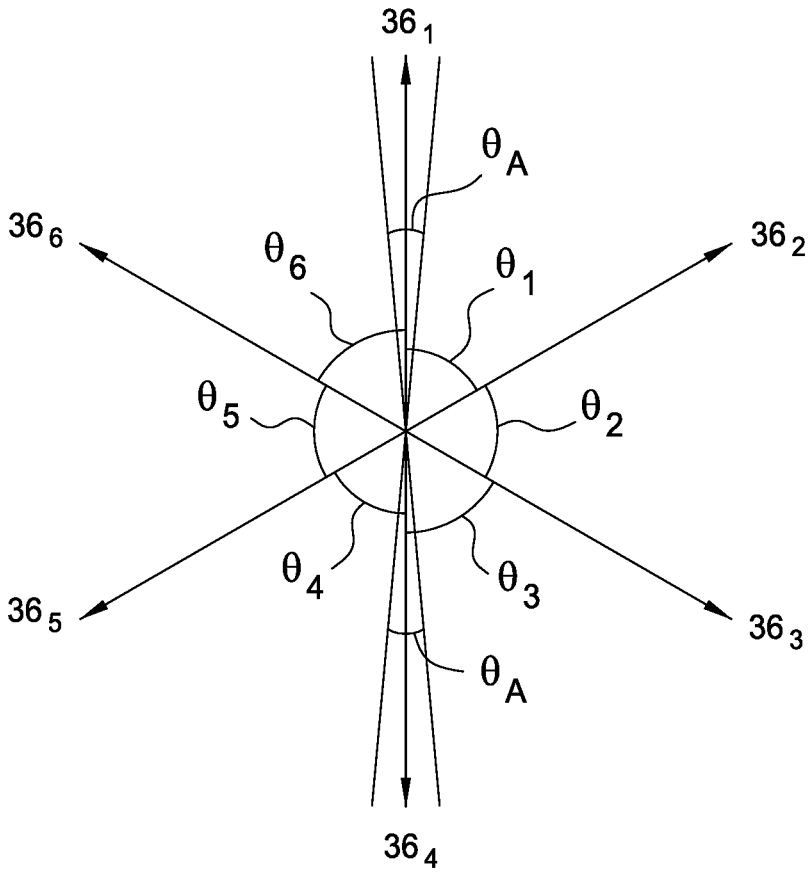
FIG. 6 depicts a top view of an example arrangement of each one of the plurality of light optics.

In addition, each one of the plurality of light optics may be arranged such that each optical axis 36 of each reflective side 108 is positioned at a predetermined angle. FIG. 6 illustrates a top view of the positioning of each one of the plurality of light optics based upon the respective optical axes 36. In one embodiment, each one of the angles $\theta_1$-$\theta_6$ may be approximately equal. For example, $\theta_1$-$\theta_6$ may each be approximately 60 degrees. In one embodiment, each one of the angles $\theta_1$-$\theta_6$ is approximately equal to within +/−10 degrees. For example, the optical axis $\mathbf{36}_1$ and $\mathbf{36}_4$ may be associated with each reflective side 108 of a first light optic and located on a common horizontal plane, the optical axis $\mathbf{36}_2$ and $\mathbf{36}_5$ may be each associated with each reflective side 108 of a second light optic and located on a common horizontal plane and the optical axis $\mathbf{36}_3$ and $\mathbf{36}_6$ may be each associated with each reflective side 108 of a third optical light optic and located on a common horizontal plane. Each light optic may be vertically stacked and rotationally oriented such that the each optical axis $\mathbf{36}_1$-$\mathbf{36}_2$ is positioned to create an angle of approximately 60 degrees for each angle $\theta_1$-$\theta_6$.

In addition, the design of the omnidirectional light 100 of the present disclosure provides a sharp horizontal cutoff of $\theta_A$ as shown in FIG. 16. As discussed above, the angle $\theta_A$ may be less than 15 degrees. As a result, when used as a beacon light for marine navigation, the omnidirectional light will allow boats or other water crafts to see a clear beginning and end of light transmitted from the omnidirectional light 100 in a horizontal direction.

As a result, the omnidirectional light 100 provides a more efficient beacon light than previous designs, while having a sharp horizontal cutoff. For example, the omnidirectional light 100 may use a single LED 104 for each one of the plurality of light optics, which may save energy over previous designs that use an array of light sources. In addition, each one of the plurality of light optics may only need a single optical feature, for example, a single reflector unlike previous designs that require multiple optical features such as reflectors, lens, mechanical blocks, and the like.

Moreover, the omnidirectional light 100 provides a compact design. For example, adding too many vertical levels of light optics may cause the omnidirectional light 100 to be unstable and prone to toppling if run into or hit by water, debris or a water craft.

Figure 3:
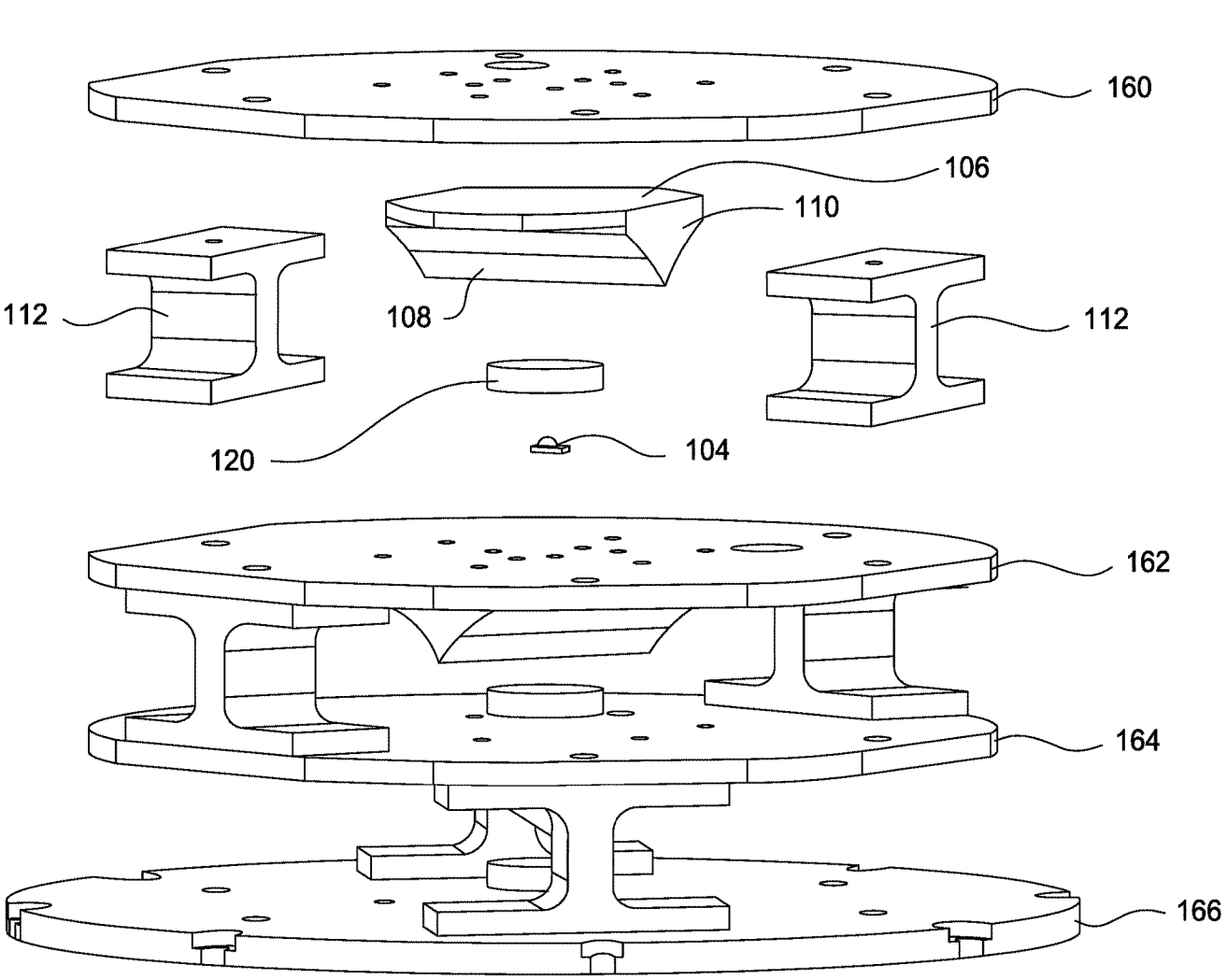
FIG. 3 depicts an exploded view of one embodiment of the omnidirectional light without the blocking band member.
Figure 4:
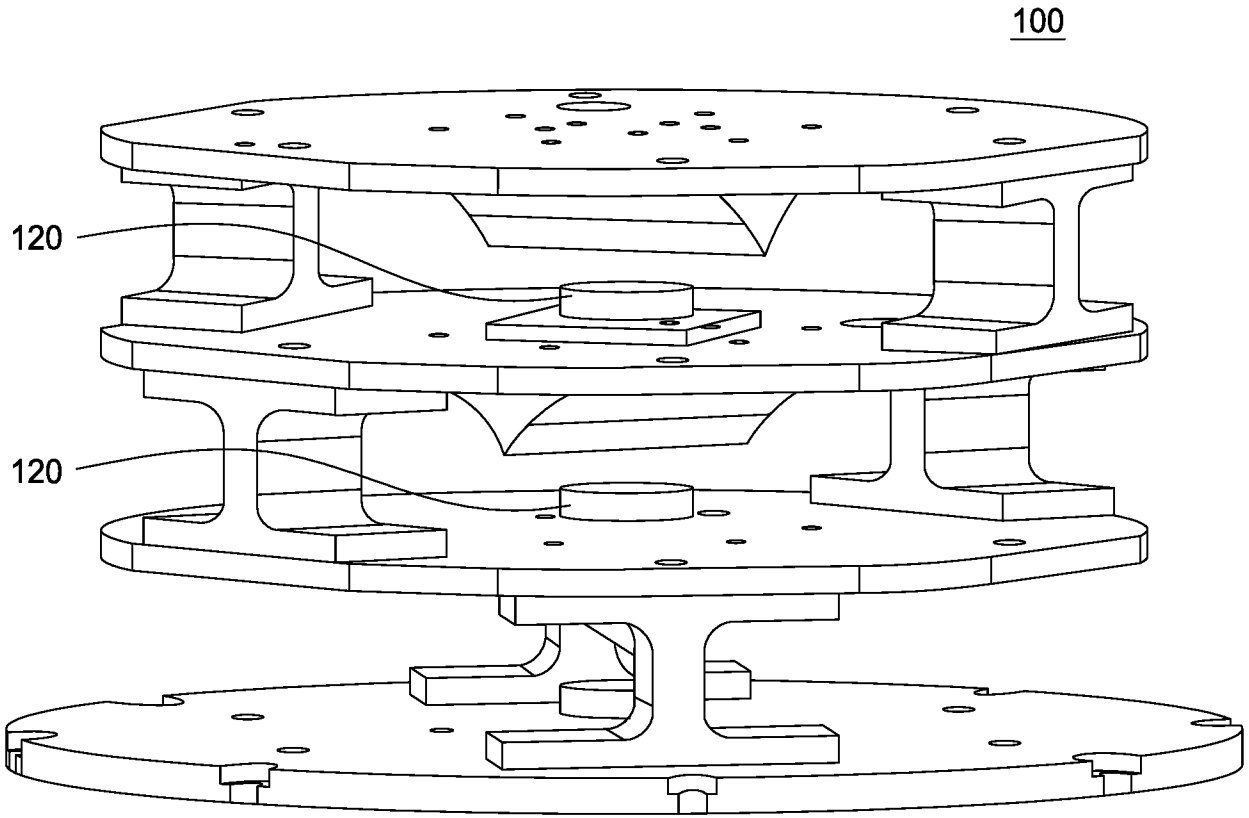
FIG. 4 depicts an isometric view of a second embodiment of an omnidirectional light having an optical blind.
Figure 17:
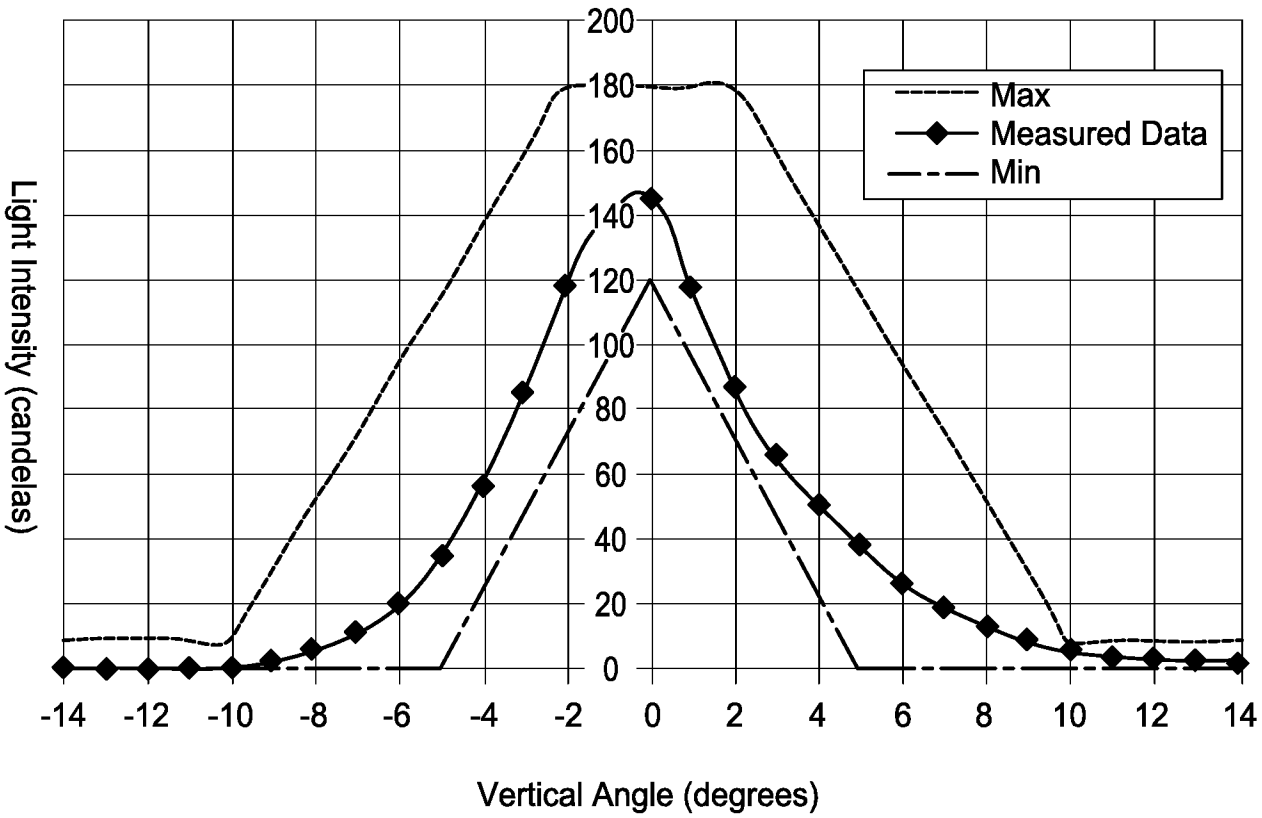
FIG. 17 depicts a graph of light intensity versus a vertical angle.
Figure 18A:
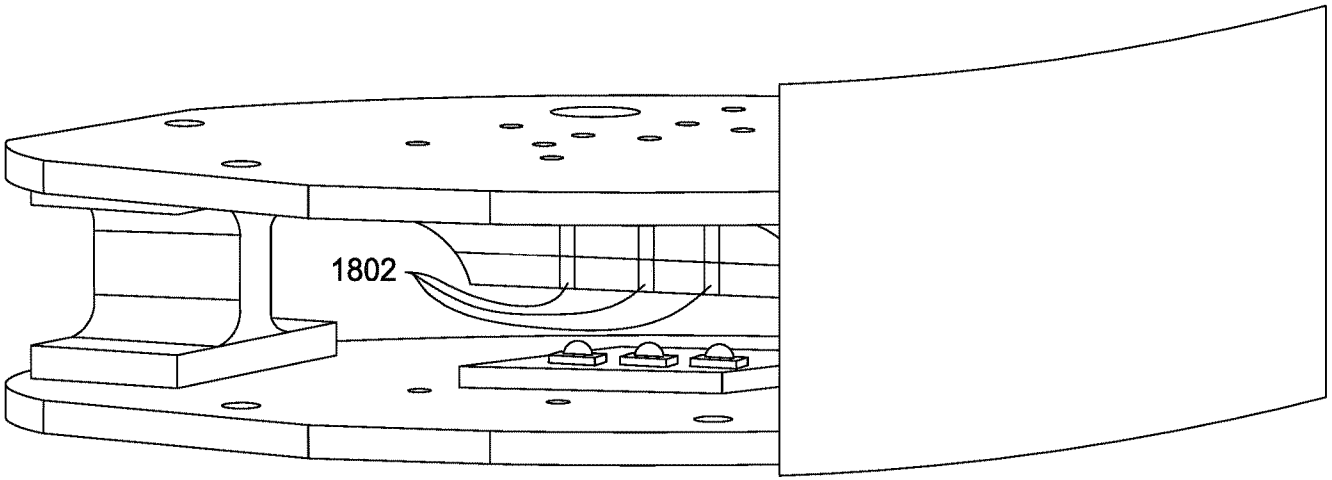
FIGS. 18A-18D depict a blocking band moving around LEDs arranged horizontally.
Figure 18B:
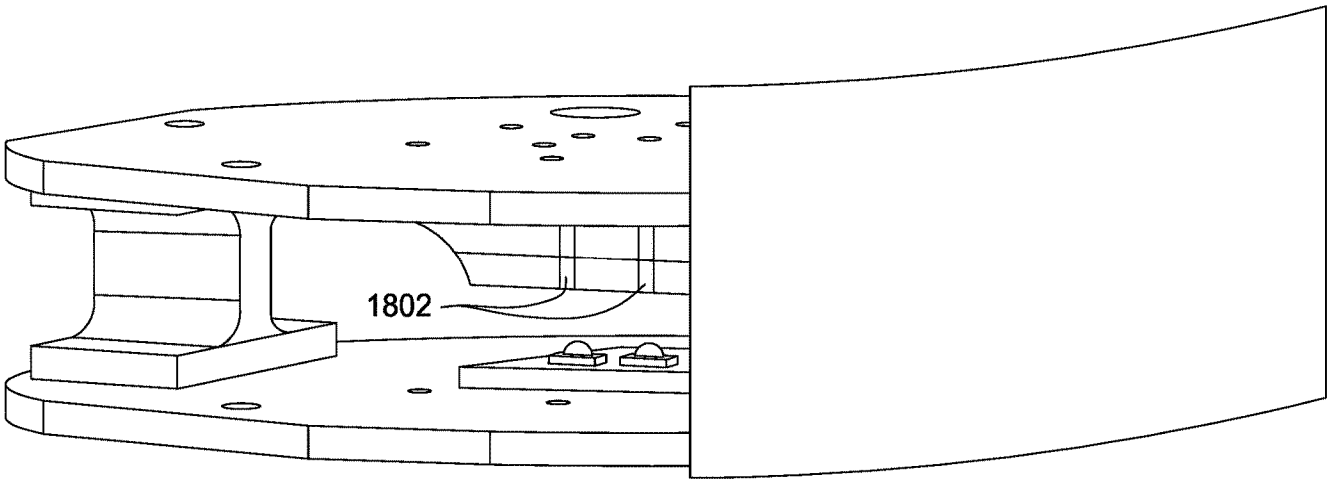
Figure 18C:
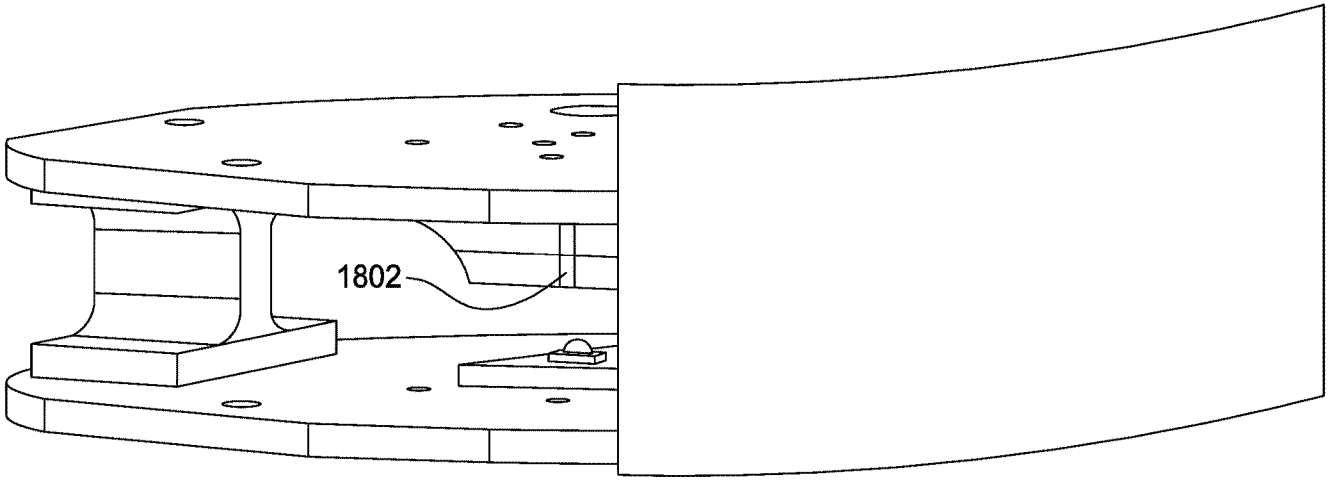
Figure 18D:
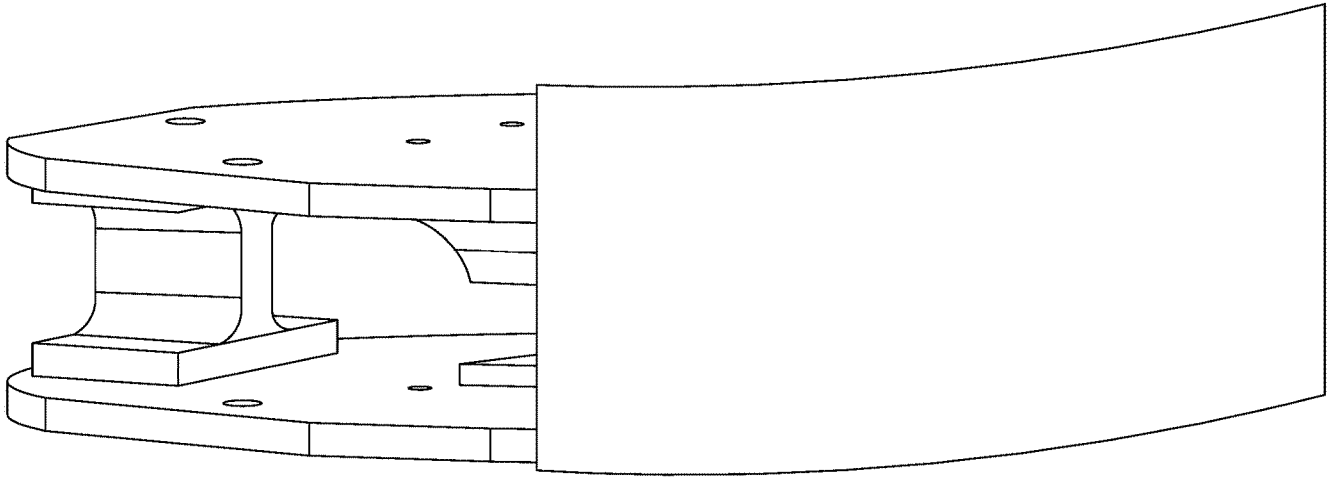

FIG. 3 illustrates an example exploded view of the omnidirectional light 100. In one embodiment, the omnidirectional light 100 may use an optional optical blind 120. In one embodiment, the optical blind may be used to block light emitted from the LED 104 at an angle of approximately 10 degrees up to 60 degrees relative to the optical axis 36. FIG. 4 illustrates an example isometric view of the omnidirectional light 100 using the optical blinds 120. In one embodiment the optical blind 120 may by non circular. FIG. 17 illustrates how the light intensity is collimated within +/−10 degrees with respect to the optical axis 36 in a vertical direction using the optical blind 120.

Figure 10:
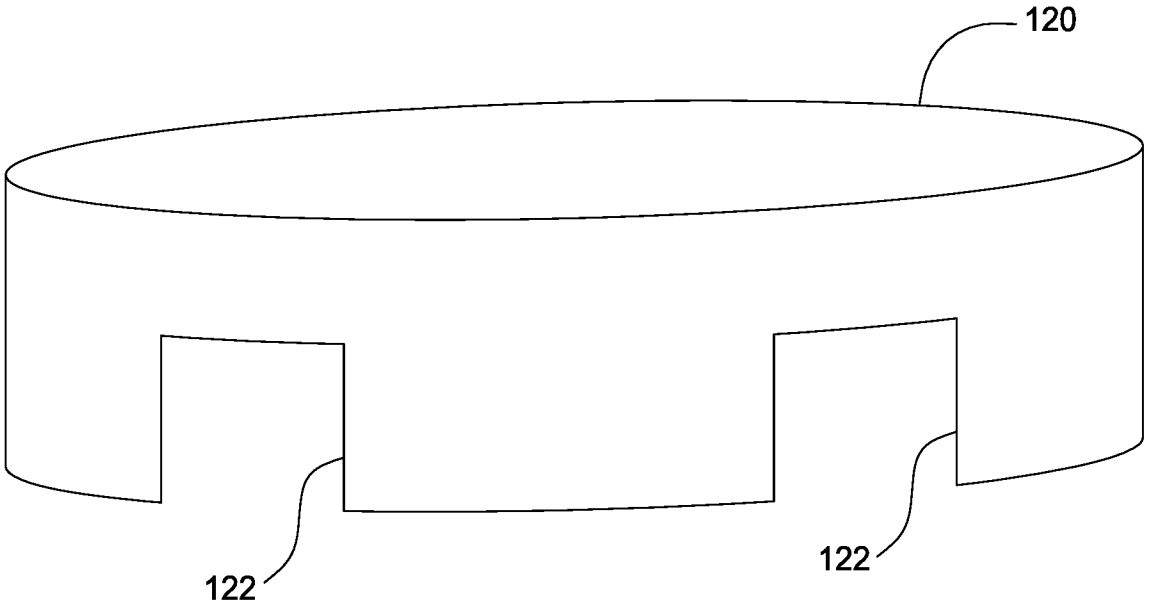
FIG. 10 depicts an embodiment of the optical blind with one or more openings.

FIG. 10 illustrates another embodiment of the optical blind 120 having cutouts 122 to allow light emitted by the LED 104 to pass through specified angles and still block light at other angles. In one embodiment, the optical blind 120 may have at least one cutout 122 that allows light emitted by the LED 104 to pass through at around 0 degrees and blocks light at some other angles between 5 degrees and 60 degrees. All angles are with respect to the optical axis 36. In one embodiment, the optical blind 120 may have six cutouts 122 that are placed approximately 60 degrees apart from each other.

Figure 8:
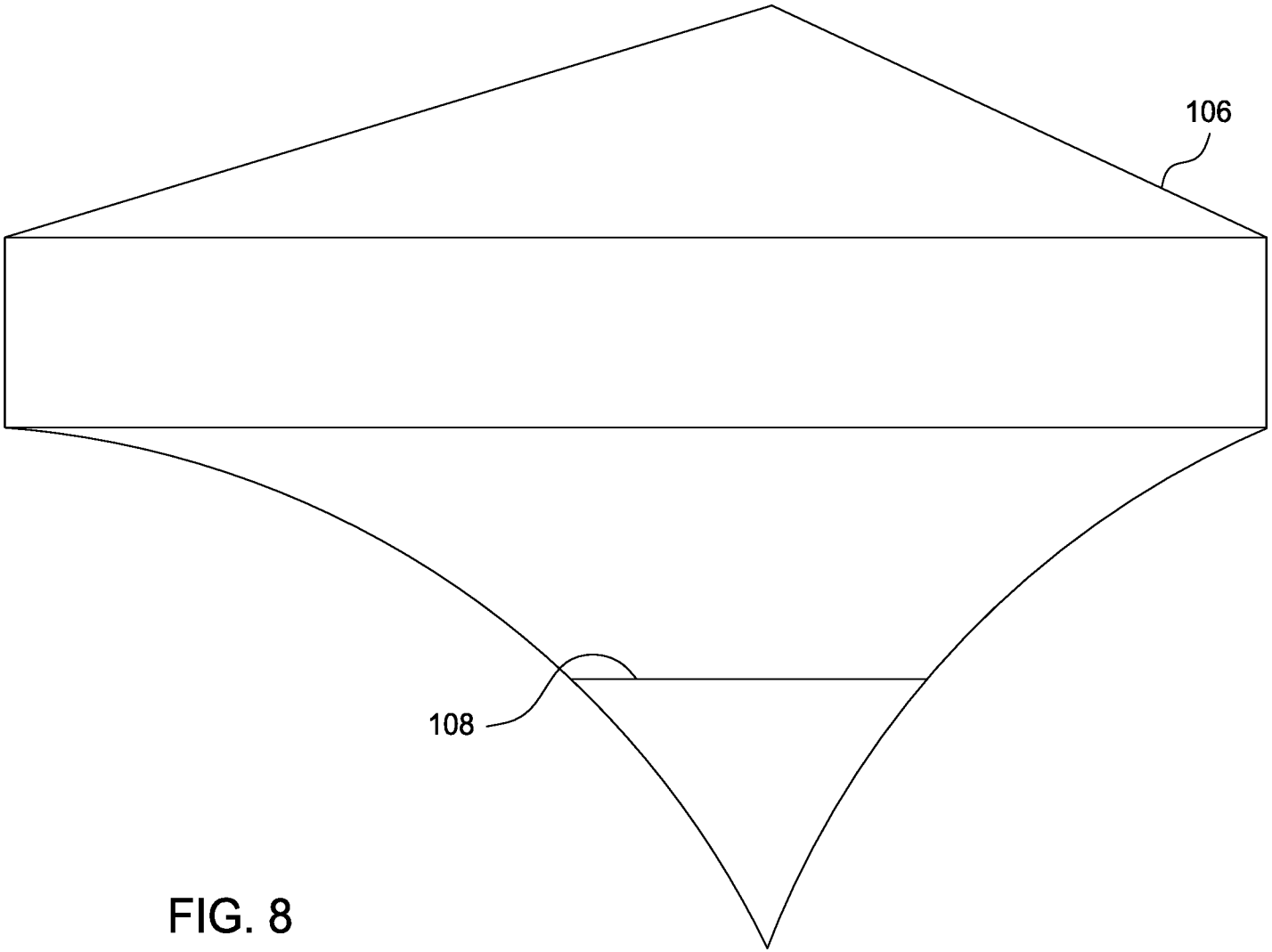
FIG. 8 depicts an embodiment of a three sided reflector.
Figure 9:
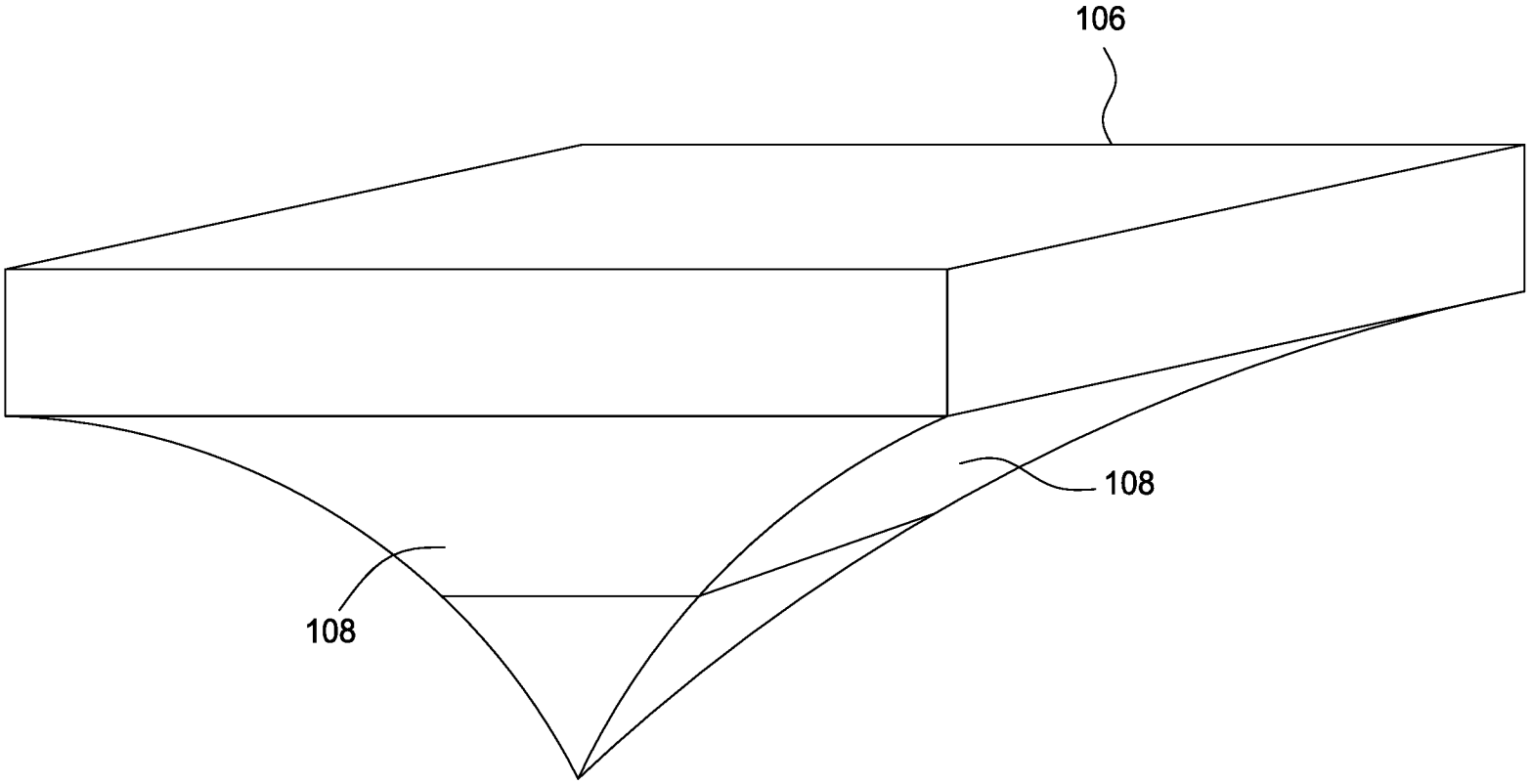
FIG. 9 depicts an embodiment of a four sided reflector.

Although the omnidirectional light 100 was described above using a reflector 106 having two reflective side 108 and having three levels, it should be noted that the reflector 106 may have any number of reflective sides. As a result, the number of levels may increase or decrease. For example, FIG. 8 illustrates a reflector 106 having three sides and FIG. 9 illustrates a reflector having 4 sides.

Figure 12:
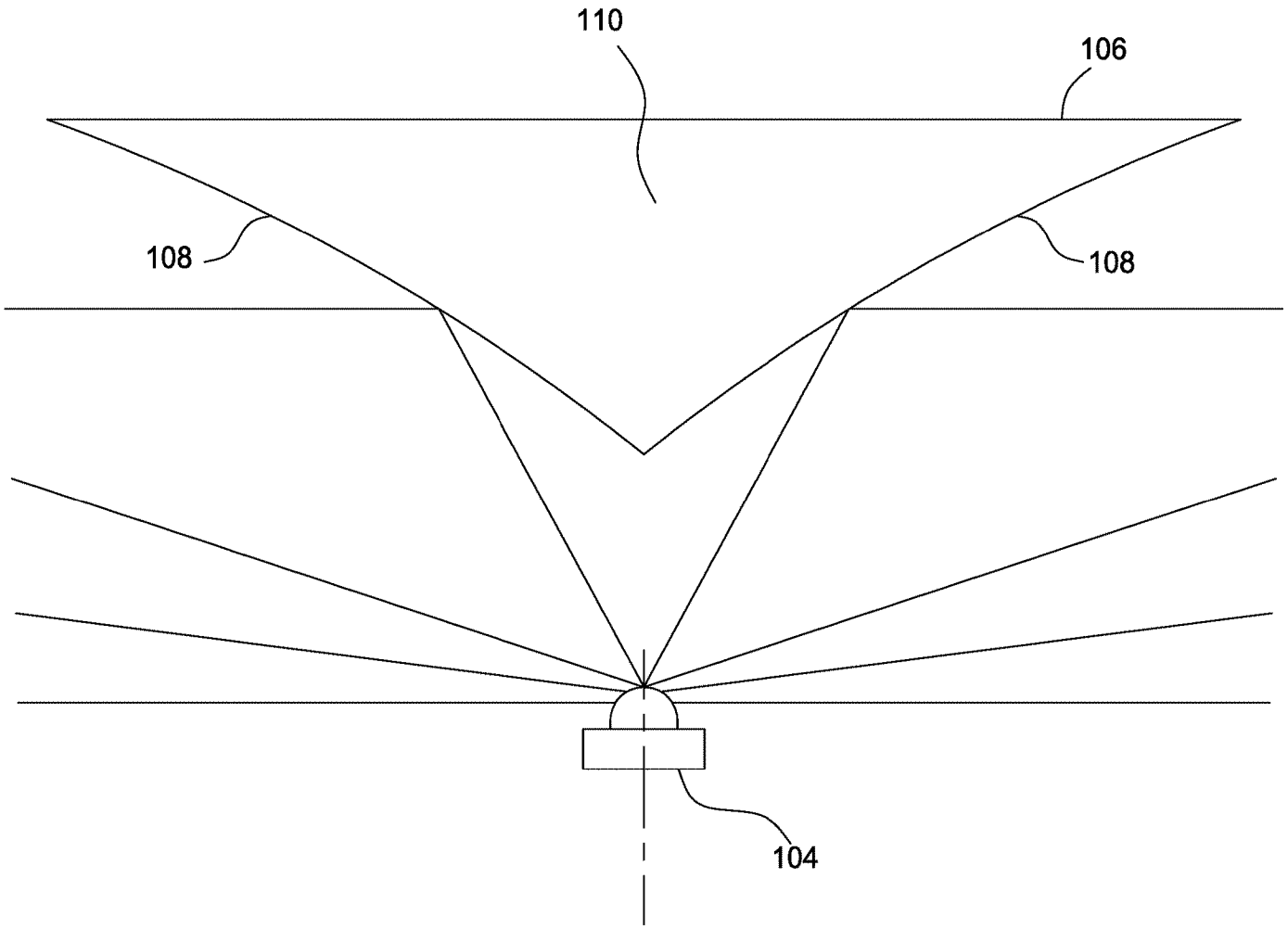
FIG. 12 depicts a cross section view of an example of light rays reflected by the reflector.
Figure 13:
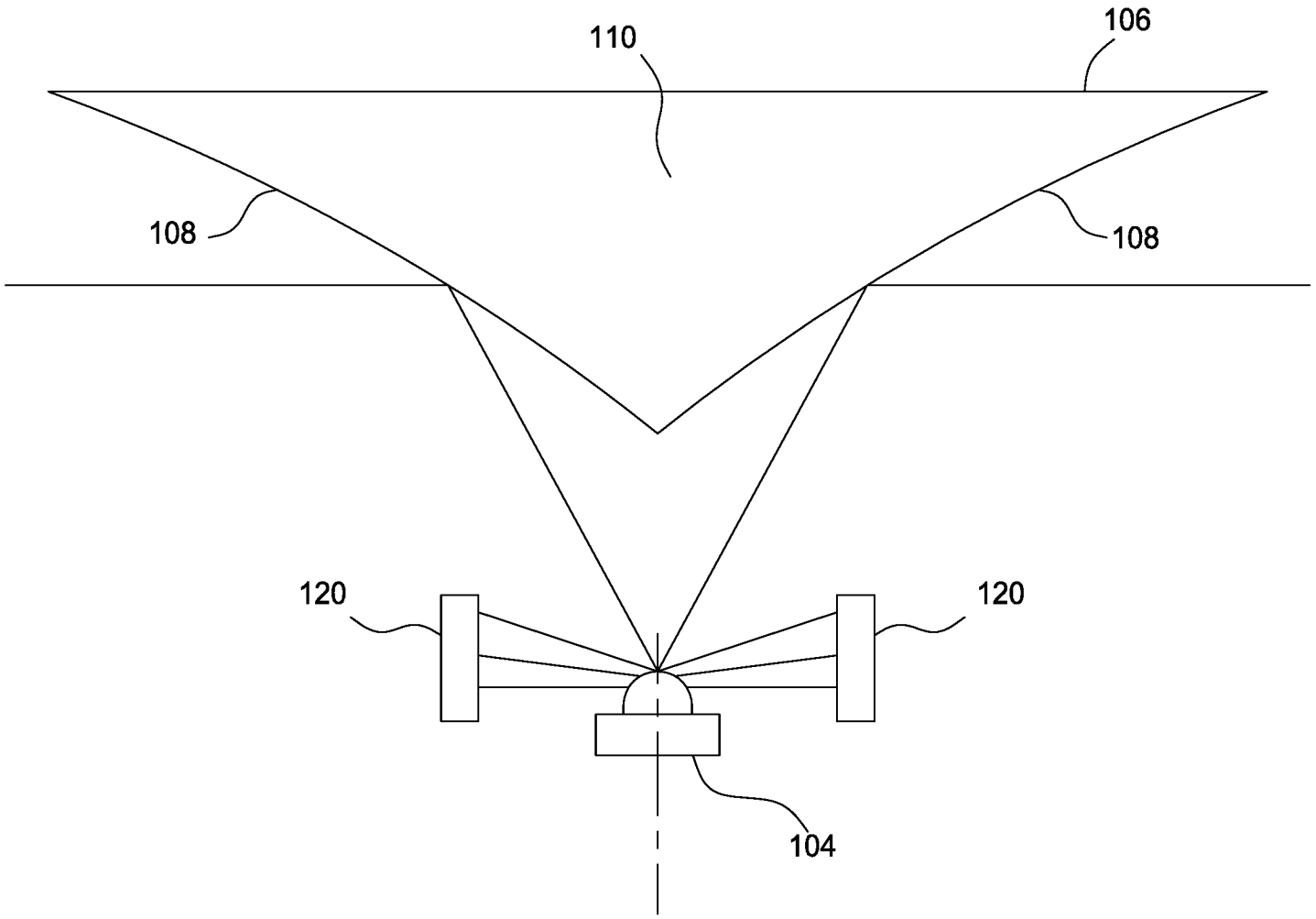
FIG. 13 depicts a cross section view of an example of light rays reflected by the reflector and the optical blind.

FIG. 12 illustrates example light rays emitted from the LED 104 and reflected by the reflector 106. FIG. 13 illustrates example light rays emitted from the LED 104 and blocked by the optional optical blind 120.

Figure 14:
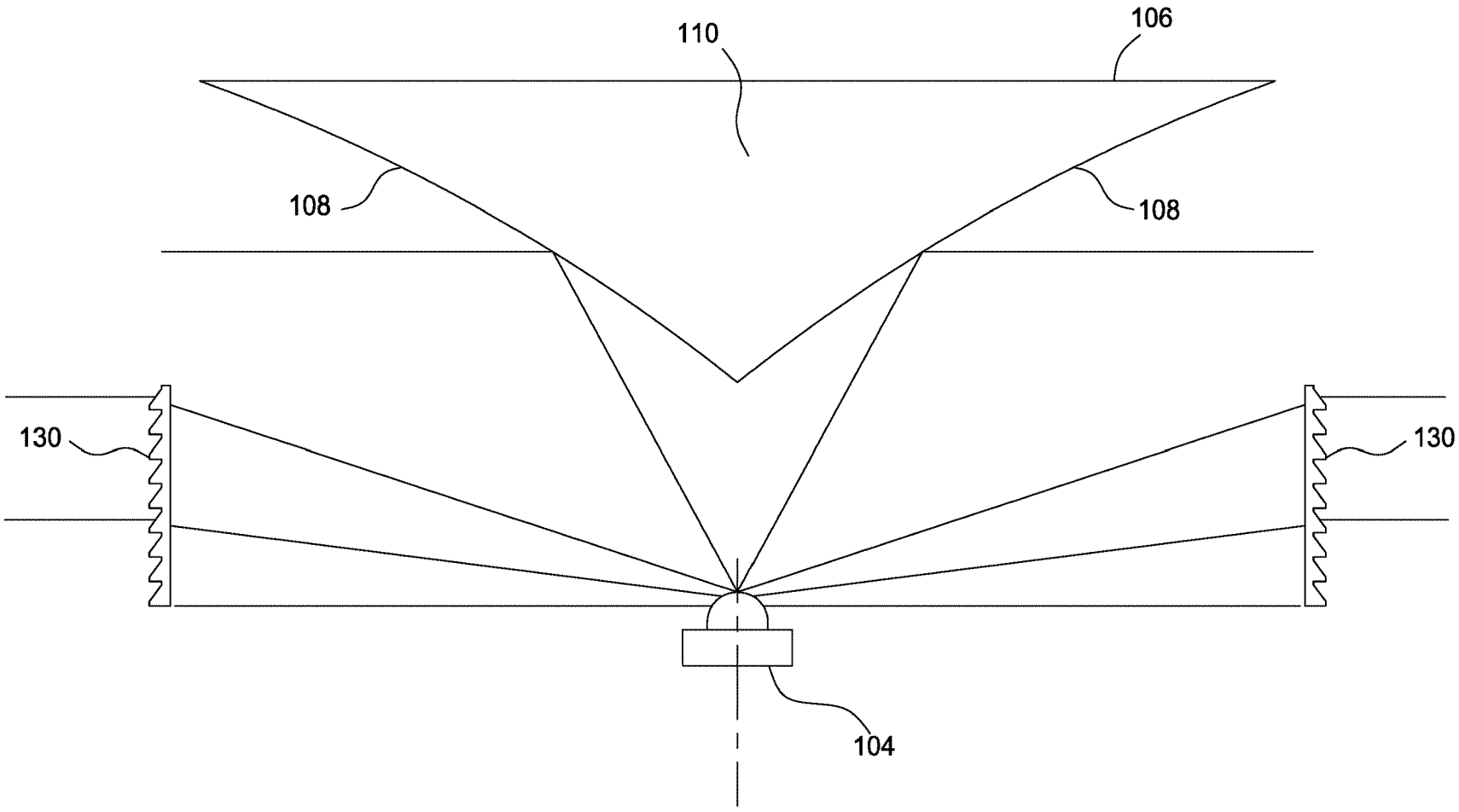
FIG. 14 depicts a cross section view of an example of light rays reflected by the reflector and re-directed by a lens.

In one embodiment, FIG. 14 illustrates example light rays emitted from the LED 104 using an optional lens 130. In one embodiment, the lens 130 may be a collimating lens that redirects light from the LED 104 and collimates light rays that may otherwise not be reflected by the reflector 106 and collimates the light along the optical axis 36 of the reflective sides 108.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An omnidirectional light, comprising:

a plurality of reflectors, wherein each one of the plurality of reflectors comprises two reflective sides that converge only at a single apex and two non-reflective sides that are opposite one another, wherein a first optical axis is associated with a first reflective side of the two reflective sides and a second optical axis is associated with a second reflective side of the two reflective sides, wherein the two reflective sides converge at the apex such that the first optical axis is angled at 180 degrees with respect to the second optical axis on a common horizontal plane and each one of the two reflective sides comprises a curved concave cross-section, wherein a first associated optical axis of a first reflective side of a first reflector of the plurality of reflectors and a second associated optical axis of a second reflective side of the first reflector of the plurality of reflectors emits light at angle on the common horizontal plane relative to a first associated optical axis and a second associated optical axis of a second reflector of the plurality of reflectors; and a plurality of light emitting diodes (LEDs) for a beacon light, wherein each one of the plurality of reflectors is associated with at least one of the plurality of LEDs located below the apex of the each one of the plurality of reflectors for emitting omnidirectional light along the common horizontal plane, wherein each one of the plurality of LEDs and each one of the plurality of reflectors is vertically stacked with respect to one another.

2. The omnidirectional light of claim 1, wherein each one of the plurality of LEDs is positioned at about 90 degrees to the associated optical axis of each one of the two reflective sides.

3. The omnidirectional light of claim 1, wherein each one of the two reflective sides is projected along a curve.

4. The omnidirectional light of claim 1 further comprising:

a lens around each one of the plurality of LEDs to concentrate light emitted by a respective one of the plurality of LEDs.

5. The omnidirectional light of claim 1, wherein each one of the plurality of reflectors collimates light within +/−10 degrees along the associated optical axis.

6. The omnidirectional light of claim 1, wherein each one of the plurality of reflectors are vertically stacked via a plurality of standoffs.

7. The omnidirectional light of claim 6, wherein respective standoffs of the plurality of standoffs of each one of the plurality reflectors are aligned with non-reflective sides of the each one of the plurality of reflectors.

8. The omnidirectional light of claim 6, wherein each one of the plurality of reflectors are coupled to different respective top plates and each one of the plurality of LEDs are coupled to different respective bottom plates.

9. The omnidirectional light of claim 8, wherein the plurality of reflectors and the plurality of LEDs are arranged such that an LED of a bottom plate are located such that a central light emitting axis of the LED is at a center point of an apex of a reflector of a top plate.

10. An omnidirectional light, comprising:

a plurality of light optics, wherein each one of the plurality of light optics is vertically stacked, wherein each one of the plurality of light optics, comprises:

at least one reflector, wherein the at least one reflector comprises two reflective sides that converge only at a single apex and two non-reflective sides that are opposite one another, wherein a first optical axis is associated with a first reflective side of the two reflective sides and a second optical axis is associated with a second reflective side of the two reflective sides, wherein the two reflective sides converge at the apex such that the first optical axis is angled at 180 degrees with respect to the second optical axis on a common horizontal plane, wherein each one of the two reflective sides comprises a curved concave cross-section, wherein a first associated optical axis of a first reflective side of a first reflector of the plurality of reflectors and a second associated optical axis of a second reflective side of the first reflector of the plurality of reflectors emits light at angle on the common horizontal plane relative to a first associated optical axis and a second associated optical axis of a second reflector of the plurality of reflectors; and at least one light emitting diode (LED) for a beacon light, wherein the at least one LED is positioned below the apex of the at least one reflector for emitting omnidirectional light along the common horizontal plane.

11. The omnidirectional light of claim 10, wherein each one of the at least one LED is positioned at about 90 degrees to the associated optical axis of each one of the two reflective sides.

12. The omnidirectional light of claim 10, wherein the plurality of light optics comprises three light optics.

13. The omnidirectional light of claim 12, wherein each one of the three light optics is positioned such the associated optical axis of each one of the two reflective sides of each one of the three light optics is approximately 60 degrees apart.

14. The omnidirectional light of claim 10, wherein the plurality of light optics is vertically stacked such that the each one of the plurality of light optics share at least one plate.

15. The omnidirectional light of claim 10, wherein each one of the two reflective sides of the each one of the plurality of light optics collimates light within +/−10 degrees along the associated optical axis.

16. The omnidirectional light of claim 10, wherein each one of the plurality of light optics is vertically stacked via a plurality of standoffs.

17. The omnidirectional light of claim 16, wherein respective standoffs of the plurality of standoffs are aligned with non-reflective sides of the at least one reflector.

18. The omnidirectional light of claim 10, wherein the at least one reflector comprises two different reflectors, wherein a single side of each one of the two different reflectors comprises the two reflective sides.

* * * * *